US009799295B2

(12) United States Patent
Zhao

(10) Patent No.: US 9,799,295 B2
(45) Date of Patent: Oct. 24, 2017

(54) SCAN DRIVING CIRCUIT AND LIQUID CRYSTAL DISPLAY DEVICE HAVING THE CIRCUIT

(71) Applicants: Shenzhen China Star Optoelectronics Technology Co., Ltd., Shenzhen, Guangdong (CN); Wuhan China Star Optoelectronics Technology Co., Ltd., Wuhan, Hubei (CN)

(72) Inventor: Mang Zhao, Guangdong (CN)

(73) Assignees: Shenzhen China Star Optoelectronics Technology Co., Ltd, Shenzhen, Guangdong (CN); Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 108 days.

(21) Appl. No.: 14/888,687

(22) PCT Filed: Sep. 29, 2015

(86) PCT No.: PCT/CN2015/091069
§ 371 (c)(1),
(2) Date: Nov. 2, 2015

(87) PCT Pub. No.: WO2017/049660
PCT Pub. Date: Mar. 30, 2017

(65) Prior Publication Data

US 2017/0169780 A1 Jun. 15, 2017

(30) Foreign Application Priority Data

Sep. 23, 2015 (CN) ..... 2015 1 0613411

(51) Int. Cl.
*G09G 3/36* (2006.01)

(52) U.S. Cl.
CPC ..... *G09G 3/3677* (2013.01); *G09G 3/3696* (2013.01); *G09G 2300/0871* (2013.01); *G09G 2310/0243* (2013.01); *G09G 2310/08* (2013.01)

(58) Field of Classification Search
CPC ..... G11C 19/28; G11C 19/184; G11C 19/287; G11C 19/00; G11C 11/24
See application file for complete search history.

(56) References Cited

U.S. PATENT DOCUMENTS 8,912,993 B2 12/2014 Chung et al.
2007/0274433 A1* 11/2007 Tobita ..... G09G 3/3677 377/64

(Continued)

FOREIGN PATENT DOCUMENTS

CN 104424876 A 3/2015
CN 104485080 A 4/2015

(Continued)

*Primary Examiner* — Olga Merkoulova
(74) *Attorney, Agent, or Firm* — Andrew C. Cheng

(57) ABSTRACT

The invention provides a scan driving circuit and a liquid crystal display device. The scan driving circuit includes: an input module for calculating a preceding-stage control signal, first and second clock signals to obtain a first control signal; a resetting module for resetting a control signal node according to a reset signal; a latching module for calculating the first control signal, the first and second clock signals to obtain a second control signal; a logic processing module for performing a logic calculation on the second control signal and a third clock signal to obtain a logic control signal; an output module for calculating the logic control signal to obtain a scan driving signal; and a scan line for receiving and transmitting the scan driving signal to a pixel unit, to reset the control signal node and the scan driving signal and thereby avoid the failure of scan driving circuit.

20 Claims, 4 Drawing Sheets

(56) References Cited

U.S. PATENT DOCUMENTS

| | | | | |
|---|---|---|---|---|
| 2008/0074161 | A1 | 3/2008 | Inoue | |
| 2008/0219401 | A1* | 9/2008 | Tobita | G09G 3/3677 377/79 |
| 2013/0120346 | A1* | 5/2013 | Chung | G09G 5/00 345/212 |
| 2013/0321052 | A1 | 12/2013 | Huber et al. | |
| 2015/0016584 | A1* | 1/2015 | Dun | G11C 27/04 377/68 |
| 2016/0125955 | A1* | 5/2016 | Pang | G11C 19/287 377/64 |
| 2016/0132170 | A1 | 5/2016 | Zhang et al. | |
| 2017/0039973 | A1 | 2/2017 | Huang | |

FOREIGN PATENT DOCUMENTS

| | | | |
|---|---|---|---|
| CN | 104793801 | A | 7/2015 |
| CN | 105118466 | A | 12/2015 |
| CN | 105185338 | A | 12/2015 |

* cited by examiner

SCAN DRIVING CIRCUIT AND LIQUID CRYSTAL DISPLAY DEVICE HAVING THE CIRCUIT

TECHNICAL FIELD

The invention relates to the field of display technology, and particularly to a scan driving circuit and a liquid crystal display device having the circuit.

DESCRIPTION OF RELATED ART

A conventional liquid crystal display device employs a scan driving circuit, i.e., uses a conventional thin film transistor type liquid crystal display device array process to manufacture a scan driving circuit on an array substrate, to realize a progressive-scan driving mode. The conventional scan driving circuit requires using a reset signal to reset a control signal node and a scan driving signal before work, if the control signal node has residual positive charges after the previous frame, the control signal node would be maintained at a logic high level, a competition would occur between a thin film transistor controlled by the control signal node and a thin film transistor controlled by the reset signal, the reset signal does not work normally and the control signal node as well as the scan driving signal do not normally be reset, which would cause the failure of the scan driving circuit.

SUMMARY

Accordingly, a technical problem mainly to be solved by the invention is to provide a scan driving circuit and a liquid crystal display device having the circuit, so as to achieve the normal reset of a control signal node and a scan driving signal and thereby avoid the failure of scan driving circuit.

In order to solve the above technical problem, a technical solution of proposed by the invention is to provide a scan driving circuit including:

an input module, configured for receiving a preceding-stage control signal, a first clock signal and a second clock signal, performing a calculation on the preceding-stage control signal, the first clock signal and the second clock signal to obtain a first control signal and outputting the first control signal;

a resetting module, connected to the input module and configured for receiving a reset signal and resetting a control signal node of the scan driving circuit according to the reset signal;

a latching module, configured for receiving the first control signal outputted by the input module, receiving the first clock signal and the second clock signal, performing a calculation on the first control signal, the first clock signal and the second clock signal to obtain a second control signal, and latching and outputting the second control signal;

a logic processing module, connected to the latching module and configured for receiving the second control signal outputted by the latching module, receiving a third clock signal, performing a logical calculation on the second control signal and the third clock signal to obtain a logic control signal and outputting the logic control signal;

an output module, connected to the logic processing module and configured for receiving the logic control signal outputted by the logic processing module, performing a calculation on the logic control signal to obtain a scan driving signal and outputting the scan driving signal; and a scan line, connected to the output module and configured for transmitting the scan driving signal outputted by the output module to a pixel unit.

In one embodiment, the input module includes first through fourth controllable switches and a first inverter; a control terminal of the first controllable switch is connected to receive the first clock signal, an input terminal of the first controllable switch is connected to a turn-on voltage terminal, an output terminal of the first controllable switch is connected to an input terminal of the second controllable switch, a control terminal of the second controllable switch is connected to receive the preceding-stage control signal and connected to a control terminal of the third controllable switch, an output terminal of the second controllable switch is connected to the resetting module, the latching module and an output terminal of the third controllable switch, an input terminal of the third controllable switch is connected to an output terminal of the fourth controllable switch, an input terminal of the fourth controllable switch is connected to a turn-off voltage terminal, a control terminal of the fourth controllable switch is connected to receive the second clock signal, an input terminal of the first inverter is connected to receive the second clock signal, and an output terminal of the first inverter is connected to output the first clock signal.

In one embodiment, the resetting module includes a fifth controllable switch; a control terminal of the fifth controllable switch is connected to receive the reset signal, an input terminal of the fifth controllable switch is connected to the turn-on voltage terminal, an output terminal of the fifth controllable switch is connected to the output terminals of the second and third controllable switches and the latching module.

In one embodiment, the latching module includes sixth through tenth controllable switches and a second inverter; a control terminal of the sixth controllable switch is connected to receive the second clock signal, an input terminal of the sixth controllable switch is connected to the turn-on voltage terminal, an output terminal of the sixth controllable switch is connected to an input terminal of the seventh controllable switch, a control terminal of the seventh controllable switch is connected to a control terminal of the eighth controllable switch, the control signal node and the logic processing module, an output terminal of the seventh controllable switch is connected to an output terminal of the eighth controllable switch, the output terminal of the fifth controllable switch and the output terminal of the second controllable switch, an input terminal of the eighth controllable switch is connected to an output terminal of the ninth controllable switch, an input terminal of the ninth controllable switch is connected to the turn-off voltage terminal, a control terminal of the ninth controllable switch is connected to an output terminal of the tenth controllable switch, a control terminal of the tenth controllable switch is connected to receive the reset signal, an input terminal of the tenth controllable switch is connected to the first controllable switch, an input terminal of the second inverter is connected to the output terminal of the fifth controllable switch, an output terminal of the second inverter is connected to the control signal node, the control terminals of the seventh and eighth controllable switches and the logic processing module.

In one embodiment, the latching module includes sixth through tenth controllable switches and a second inverter; a control terminal of the sixth controllable switch is connected to receive the second clock signal, an input terminal of the sixth controllable switch is connected to the turn-on voltage terminal, an output terminal of the sixth controllable switch is connected to an input terminal of the seventh controllable switch, a control terminal of the seventh controllable switch is connected to a control terminal of the eighth controllable switch, the control signal node and the logic processing module, an output terminal of the seventh controllable switch is connected to an output terminal of the eighth controllable switch, the output terminal of the fifth controllable switch and the output terminal of the second controllable switch, an input terminal of the eighth controllable switch is connected to an output terminal of the ninth controllable switch, an input terminal of the ninth controllable switch is connected to an output terminal of the tenth controllable switch, a control terminal of the ninth controllable switch is connected to receive the first clock signal, a control terminal of the tenth controllable switch is connected to receive the reset signal, an input terminal of the tenth controllable switch is connected to the turn-off voltage terminal, an input terminal of the second inverter is connected to the output terminal of the fifth controllable switch, an output terminal of the second inverter is connected to the control signal node, the control terminals of the seventh and eighth controllable switches and the logic processing module.

In one embodiment, the latching module includes sixth through ninth controllable switches and an AND gate; a control terminal of the sixth controllable switch is connected to receive the second clock signal, an input terminal of the sixth controllable switch is connected to the turn-on voltage terminal, an output terminal of the sixth controllable switch is connected to an input terminal of the seventh controllable switch, a control terminal of the seventh controllable switch is connected to a control terminal of the eighth controllable switch, the control signal node and the logic processing module, an output terminal of the seventh controllable switch is connected to an output terminal of the eighth controllable switch, the output terminal of the fifth controllable switch and the output terminal of the second controllable switch, an input terminal of the eighth controllable switch is connected to an output terminal of the ninth controllable switch, an input terminal of the ninth controllable switch is connected to the turn-off voltage terminal, a control terminal of the ninth controllable switch is connected to an output terminal of the AND gate, a first input terminal of the AND gate is connected to receive the reset signal, a second input terminal of the AND gate is connected to receive the first clock signal, an input terminal of a second inverter is connected to the output terminal of the fifth controllable switch, an output terminal of the second inverter is connected to the control signal node, the control terminals of the seventh and eighth controllable switches and the logic processing module.

In one embodiment, the logic processing module includes eleventh through fourteenth controllable switches; an input terminal of the eleventh controllable switch is connected to an input terminal of the twelfth controllable switch, a control terminal of the eleventh controllable switch is connected to the control signal node and a control terminal of the thirteenth controllable switch, an output terminal of the eleventh controllable switch is connected to an output terminal of the twelfth controllable switch, the output module and an output terminal of the thirteenth controllable switch, a control terminal of the twelfth controllable switch is connected to receive the third clock signal and connected to a control terminal of the fourteenth controllable switch, an input terminal of the thirteenth controllable switch is connected to an output terminal of the fourteenth controllable switch, and an input terminal of the fourteenth controllable switch is connected to the turn-off voltage terminal.

In one embodiment, the output module includes third through fifth inverters; an input terminal of the third inverter is connected to the output terminals of the eleventh and thirteenth controllable switches, an output terminal of the third inverter is connected to an input terminal of the fourth inverter, an output terminal of the fourth inverter is connected to an input terminal of the fifth inverter, and an output terminal of the fifth inverter is connected to the scan line.

In one embodiment, the first controllable switch, the second controllable switch, the fifth through seventh controllable switches, the eleventh controllable switch and the twelfth controllable switch are PMOS-type thin film transistors; the third controllable switch, the fourth controllable switch, the eighth through tenth controllable switches, the thirteenth controllable switch and the fourteenth controllable switch are NMOS-type thin film transistors.

In order to solve the above technical problem, another technical solution proposed by the invention is to provide a liquid crystal display device including any one of the above described scan driving circuits.

Beneficial effects can be achieved by the invention are that: different from the prior art, during the resetting module of the scan driving circuit of the invention is in operation, the reset signal is at a low level, the fifth controllable switch is controlled to be turned on, at this time, whatever the voltage levels at the control signal node and of the first clock signal are, the voltage at the turn-off voltage terminal does not be provided to the control signal node, so that the purpose of resetting the control signal node and the scan driving signal is achieved, and the failure of scan driving circuit can be avoid as a result.

DETAILED DESCRIPTION OF EMBODIMENTS

Figure 1:
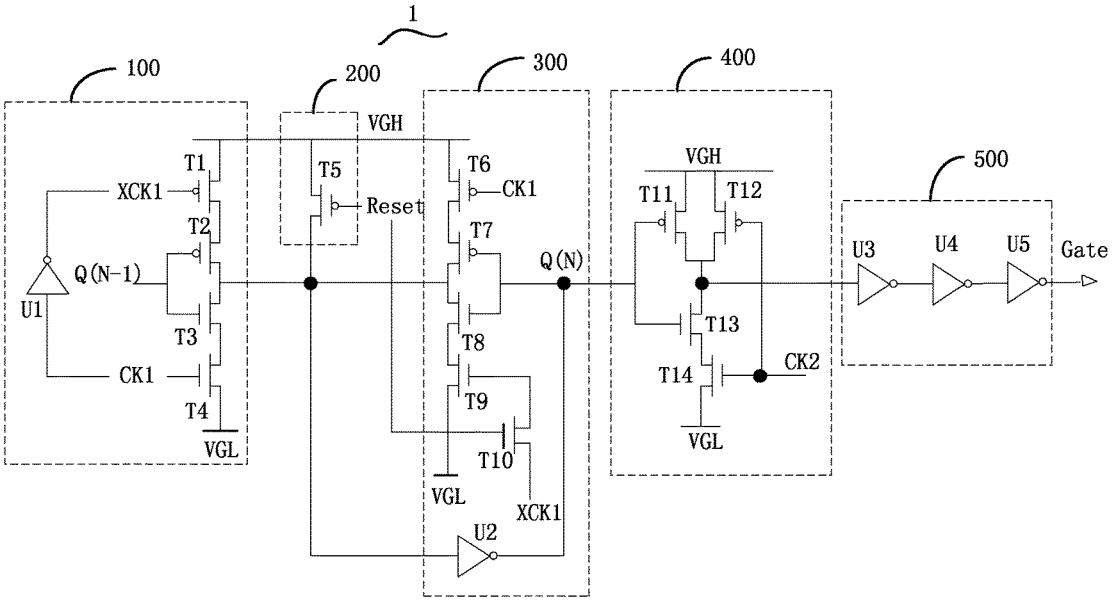
FIG. 1 is a schematic structural view of a scan driving circuit of a first embodiment of the invention.

Referring to FIG. 1, which is a schematic structural view of a scan driving circuit of a first embodiment of the invention. As illustrated in FIG. 1, the scan driving circuit 1 associated with the invention includes: an input module 100 configured (i.e., structured and arranged) for receiving a previous-stage control signal, a first clock signal and a second clock signal, calculating the previous-stage control signal, the first clock signal and the second clock signal to obtain a first control signal and outputting the first control signal; a resetting module 200 connected to the input module 100 and configured for receiving a reset signal and resetting a control signal node of the scan driving circuit according to the reset signal; a latching module 300 configured for receiving the first control signal outputted by the input module 100, receiving the first clock signal and the second clock signal, calculating the first control signal, the first clock signal and the second clock signal to obtain a second control signal, and latching and outputting the second control signal; a logic processing module 400 connected to the latching module 300 and configured for receiving the second control signal outputted by the latching module 300, receiving a third clock signal, performing a logic calculation onto the second control signal and the third clock signal to obtain a logic control signal and outputting the logic control signal; an output module 500 connected to the logic processing module 400 and configured for receiving the logic control signal outputted by the logic processing module 400, performing a calculation onto the logic control signal to obtain a scan driving signal and outputting the scan driving signal; and a scan line connected to the output module 500 and configured for transmitting the scan driving signal outputted by the output module 500 to a pixel unit.

The input module 100 includes first through fourth controllable switches T1-T4 and a first inverter U1. A control terminal of the first controllable switch T1 is connected to receive the first clock signal, an input terminal of the first controllable switch T1 is connected to a turn-on voltage terminal VGH, and an output terminal of the first controllable switch T1 is connected to an input terminal of the second controllable switch T2. A control terminal of the second controllable switch T2 is connected to receive the preceding-stage control signal and connected to a control terminal of the third controllable switch T3, and an output terminal of the second controllable switch T2 is connected to the resetting module 200, the latching module 300 and an output terminal of the third controllable switch T3. An input terminal of the third controllable switch T3 is connected to an output terminal of the fourth controllable switch T4, an input terminal of the fourth controllable switch T4 is connected to a turn-off voltage terminal VGL, and a control terminal of the fourth controllable switch T4 is connected to the second clock signal. An input terminal of the first inverter U1 is connected to receive the second clock signal, and an output terminal of the first inverter U1 is connected to output the first clock signal.

The resetting module 200 includes a fifth controllable switch T5. A control terminal of the fifth controllable switch T5 is connected to receive the reset signal, an input terminal of the fifth controllable switch T5 is connected to the turn-on voltage terminal VGH, and an output terminal of the fifth controllable switch T5 is connected to the output terminals of the second and third controllable switches T2, T3 and the latching module 300.

The latching module 300 includes sixth through tenth controllable switches T6-T10 and an inverter U2. A control terminal of the sixth controllable switch T6 is connected to receive the second clock signal, an input terminal of the sixth controllable switch T6 is connected to the turn-on voltage terminal VGH, and an output terminal of the sixth controllable switch T6 is connected to an input terminal of the seventh controllable switch T7. A control terminal of the seventh controllable switch T7 is connected to a control terminal of the eighth controllable switch T8, the control signal node and the logic processing module 400, and an output terminal of the seventh controllable switch T7 is connected to an output terminal of the eighth controllable switch T8, the output terminal of the fifth controllable switch T5 and the output terminal of the second controllable switch T2. An input terminal of the eighth controllable switch T8 is connected to an output terminal of the ninth controllable switch T9, an input terminal of the ninth controllable switch T9 is connected to the turn-off voltage terminal VGL, and a control terminal of the ninth controllable switch T9 is connected to an output terminal of the tenth controllable switch T10. A control terminal of the tenth controllable switch T10 is connected to receive the reset signal, and an input terminal of the tenth controllable switch T10 is connected to the first controllable switch. An input terminal of the inverter U2 is connected to the output terminal of the fifth controllable switch T5, and an output terminal of the inverter U2 is connected to the control signal node, the output terminals of the seventh and eighth controllable switches T7, T8 and the logic processing module 400.

The logic processing module 400 includes eleventh through fourteenth controllable switches T11-T14. An input terminal of the eleventh controllable switch T11 is connected to an input terminal of the twelfth controllable switch T12, a control terminal of the eleventh controllable switch T11 is connected to the control signal node and a control terminal of the thirteenth controllable switch T13, and an output terminal of the eleventh controllable switch T11 is connected to an output terminal of the twelfth controllable switch T12, the output module 500 and an output terminal of the thirteenth controllable switch T13. A control terminal of the twelfth controllable switch T12 is connected to receive the third clock signal and connected to a control terminal of the fourteenth controllable switch T14, and an input terminal of the thirteenth controllable switch T13 is connected to an output terminal of the fourteenth controllable switch T14. An input terminal of the fourteenth controllable switch T14 is connected to the turn-off voltage terminal VGL.

The output module 500 includes third through fifth inverters U3-U5. An input terminal of the third inverter U3 is connected to the output terminals of the eleventh and thirteenth controllable switches T11, T13, and an output terminal of the third inverter U3 is connected to an input terminal of the fourth inverter U4. An output terminal of the fourth inverter U4 is connected to an input terminal of the fifth inverter U5. An output terminal of the fifth inverter U5 is connected to the scan line.

The first embodiment only uses one scan driving circuit as an example for the purpose of illustration, the preceding-stage control signal is a preceding-stage control signal Q(N−1), the first clock signal is a first clock signal XCK1, the second clock signal is a second clock signal CK1, the reset signal is a reset signal Reset, the third clock signal is a third clock signal CK2, the control signal node is a control signal node Q(N), and the scan line is a scan line Gate.

A working principle of the scan driving circuit 1 of the first embodiment is as follows:

When the resetting module 200 works, the reset signal Reset is at a low voltage level, the control terminal of the fifth controllable switch T5 receives the low voltage level signal and thus is turned on, the control terminal of the tenth controllable switch T10 receives the low level signal and thus is turned off, the high voltage level of the first clock signal XCK1 cannot be applied to the control terminal of the ninth controllable switch T9, the ninth controllable switch T9 is turned off, and at this time, even if the high voltage level at the control signal node Q(N) controls the eighth controllable switch T8 to be turned on, the voltage at the turn-off voltage terminal VGL cannot be provided to the control signal node Q(N), and therefore the high voltage level at the control signal node Q(N) would not affect the normal working of the reset signal Reset, the control signal node Q(N) will become a low voltage level when the low voltage level of the reset signal Reset comes, so that the control signal node Q(N) and the scan driving signal are reset.

Figure 2:
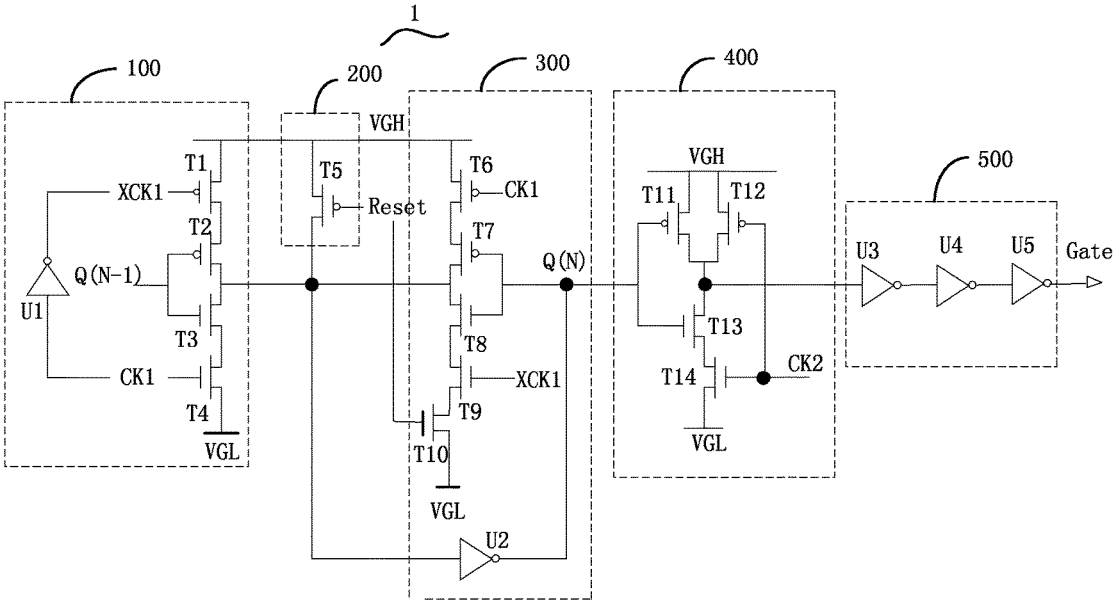
FIG. 2 is a schematic structural view of a scan driving circuit of a second embodiment of the invention.

Referring to FIG. 2, which is a schematic structural view of a scan driving circuit of a second embodiment of the invention. As illustrated in FIG. 2, Differences between the scan driving circuit of the second embodiment and the scan driving circuit of the first embodiment are that: the latching module 300 includes sixth through tenth controllable switches T6-T10 and the second inverter U2, a control terminal of the sixth controllable switch T6 is connected to receive the second clock signal, an input terminal of the sixth controllable switch T6 is connected to a turn-on voltage terminal VGH, an output terminal of the sixth controllable switch T6 is connected to an input terminal of the seventh controllable switch T7, a control terminal of the seventh controllable switch T7 is connected to a control terminal of the eighth controllable switch T8, the control signal node and the logic processing module 400, an output terminal of the seventh controllable switch T7 is connected to an output terminal of the eighth controllable switch T8, the output terminal of the fifth controllable switch T5 and the output terminal of the second controllable switch T2, an input terminal of the eighth controllable switch T8 is connected to an output terminal of the ninth controllable switch T9, an input terminal of the ninth controllable switch T9 is connected to an output terminal of the tenth controllable switch T10, a control terminal of the ninth controllable switch T9 is connected to receive the first clock signal, a control terminal of the tenth controllable switch T10 is connected to receive the reset signal, an input terminal of the tenth controllable switch T10 is connected to a turn-off voltage terminal VGL, an input terminal of the second inverter U2 is connected to the output terminal of the fifth controllable switch T5, an output terminal of the second inverter U2 is connected to the control signal node, the control terminals of the seventh and eighth controllable switches T7, T8 and the logic processing module 400.

A working principle of the scan driving circuit 1 of the second embodiment is as follows:

When the resetting module 200 is in operation, the reset signal Reset is at a low voltage level, the control terminal of the fifth controllable switch T5 receives the low voltage level signal and thus is turned on, the control terminal of the tenth controllable switch T10 receives the low voltage level signal and thus is turned off, at this time even if the high voltage levels of the control signal node Q(N) and the first clock signal XCK1 control the eighth controllable switch T8 and the ninth controllable switch T9 to be turned on, the voltage at the turn-off voltage terminal VGL cannot be provided to the control signal node Q(N), the high voltage level at the control signal node Q(N) does not affect the normal working of the reset signal Reset, the control signal node Q(N) will become to be at a low voltage level when the low voltage level of the reset signal Reset comes, and therefore the control signal node Q(N) and the scan driving signal are reset.

Figure 3:
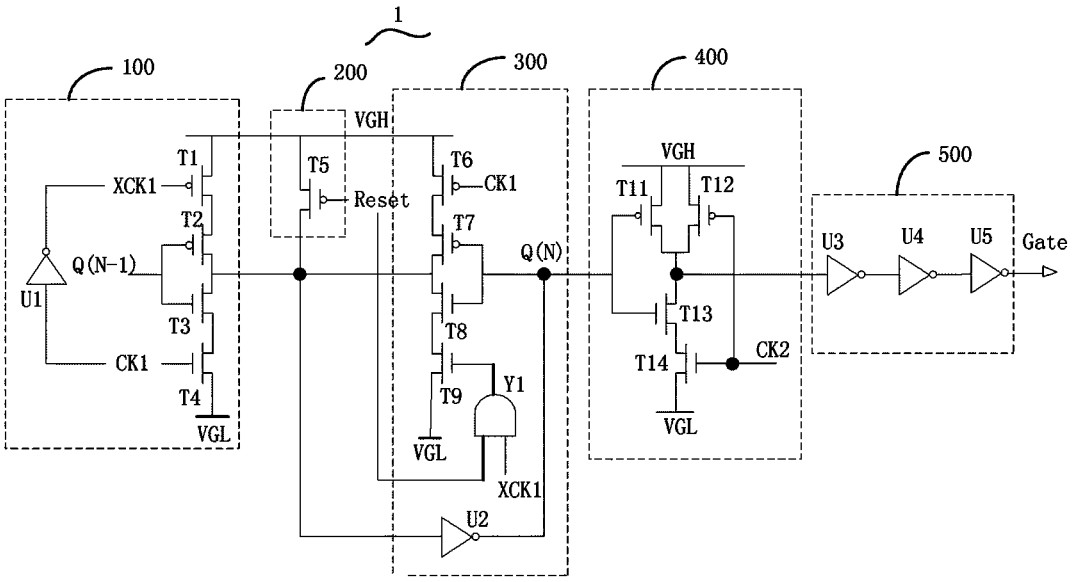
FIG. 3 is a schematic structural view of a scan driving circuit of a third embodiment of the invention.

Referring to FIG. 3, which is a schematic structural view of a scan driving circuit of a third embodiment of the invention. As illustrated in FIG. 3, differences between the scan driving circuit of the third embodiment and the scan driving circuit of the first embodiment are that: the latching module 300 includes sixth through ninth controllable switches T6-T9 and an AND gate Y1, a control terminal of the sixth controllable switch T6 is connected to receive the second clock signal, an input terminal of the sixth controllable switch T6 is connected to the turn-on voltage terminal VGH, an output terminal of the sixth controllable switch T6 is connected to an input terminal of the seventh controllable switch T7, a control terminal of the seventh controllable switch T7 is connected to a control terminal of the eighth controllable switch T8, the control signal node and the logic processing module 400, an output terminal of the seventh controllable switch T7 is connected to the output terminal of the eighth controllable switch T8, the output terminal of the fifth controllable switch T5 and the output terminal of the second controllable switch T2, an input terminal of the eighth controllable switch T8 is connected to the output terminal of the ninth controllable switch T9, an input terminal of the ninth controllable switch T9 is connected to the turn-off voltage terminal VGL, a control terminal of the ninth controllable switch T9 is connected to an output terminal of the AND gate Y1, a first input terminal of the AND gate Y1 is connected to receive the reset signal, a second input terminal of the AND gate Y1 is connected to receive the first clock signal, an input terminal of the second inverter is connected to the output terminal of the fifth controllable switch T5, an output terminal of the second inverter U2 is connected to the control signal node, the control terminals of the seventh and eighth controllable switches T7, T8 and the logic processing module 400.

A working principle of the scan driving circuit 1 of the third embodiment is as follows:

When the resetting module 200 works, the reset signal Reset is at a low voltage level, the control terminal of the fifth controllable switch T5 receives the low voltage level signal and thus is turned on, the first input terminal of the AND gate Y1 receives the low voltage level signal, at this time regardless of the first clock signal XCK1 received by the second input terminal of the AND gate Y1 being at a high voltage level or a low voltage level, the output terminal of the AND gate Y1 always outputs a low voltage level signal to the control terminal of the ninth controllable switch T9 so as to control the ninth controllable switch T9 to be turned off, and at this time even if the high voltage level at the control signal node Q(N) controls the eighth controllable switch T8 to be turned on, the turn-off voltage VGL does not be provided to the control signal node Q(N), the high voltage level at the control signal node Q(N) does not affect the normal working of the reset signal Reset, the control signal node Q(N) will become to be at a low voltage level when the low voltage level of the reset signal Reset comes, and therefore the control signal node Q(N) and the scan driving signal are reset.

The first controllable switch T1, the second controllable switch T2, the fifth through seventh controllable switches T5-T7, the eleventh controllable switch T11 and the twelfth controllable switch T12 are PMOS-type thin film transistors. The third controllable switch T3, the fourth controllable switch T4, the eighth through tenth controllable switches T8-T10, the thirteenth controllable switch T13 and the fourteenth controllable switch T14 are NMOS-type thin film transistors.

Figure 4:
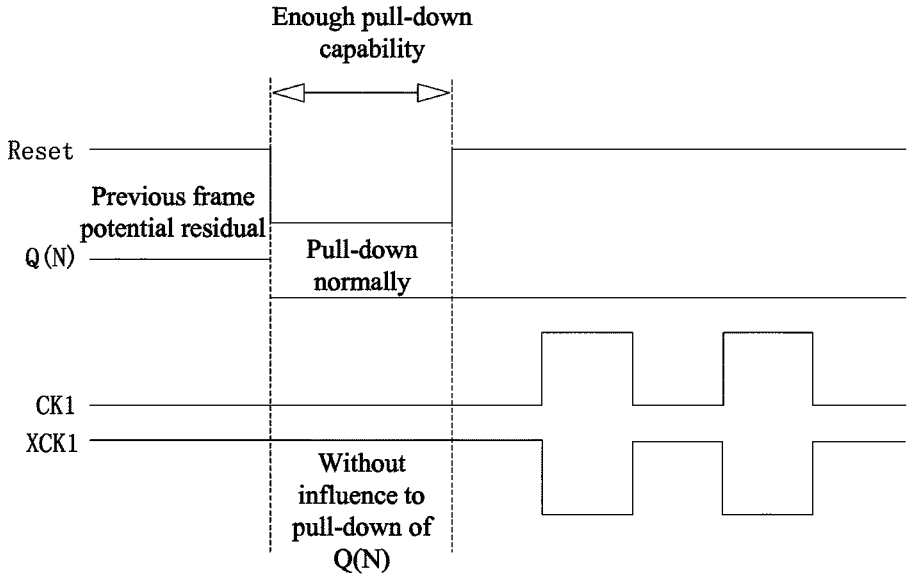
FIG. 4 is a working timing diagram of a scan driving circuit of the invention avoiding a competition risk point.
Figure 5:
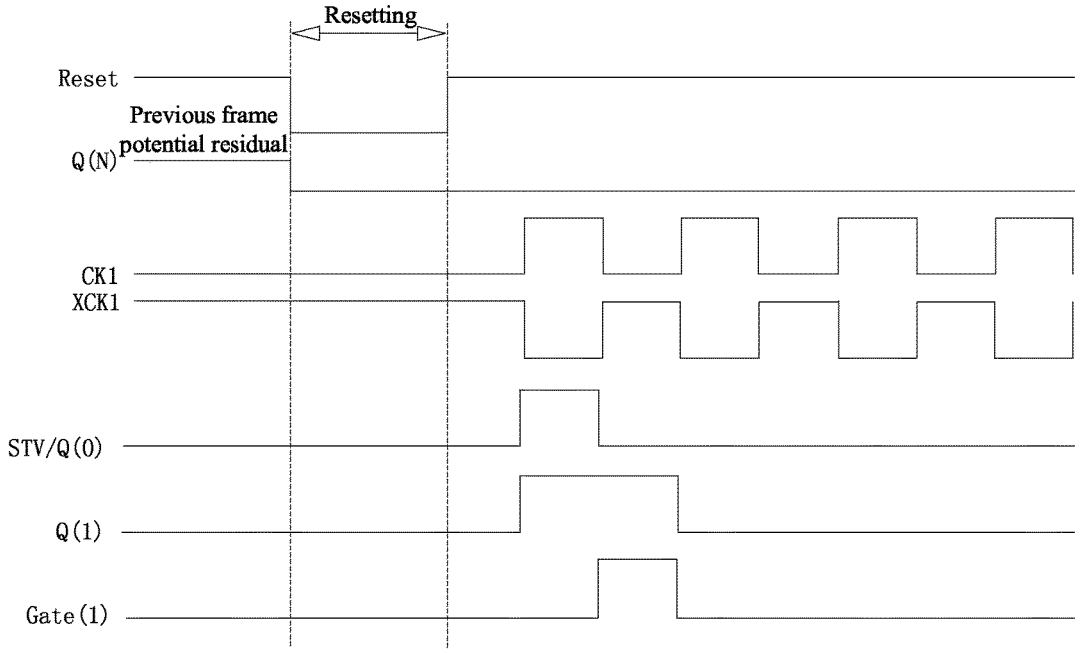
FIG. 5 is a working timing diagram of a scan driving circuit of the invention.

Referring to FIG. 4 and FIG. 5, wherein FIG. 4 is a timing diagram of the scan driving circuit 1 of the invention avoiding a competition risk point, and FIG. 5 is a working timing diagram of the scan driving circuit 1 of the invention. According to the analysis to FIG. 4 and FIG. 5, It is found that when the resetting module 200 is in operation, the reset signal Reset is at a low voltage level, the voltage at the turn-off voltage terminal VGL does not be provided to the control signal node Q(N) (i.e., there is no competition), the control signal node Q(N) and the scan driving signal can be normally pulled down, before the scan driving circuit 1 normally works, states of all working nodes can be maintained at normal voltage levels, and therefore the scan driving circuit 1 would not encounter the risk of failure.

Figure 6:
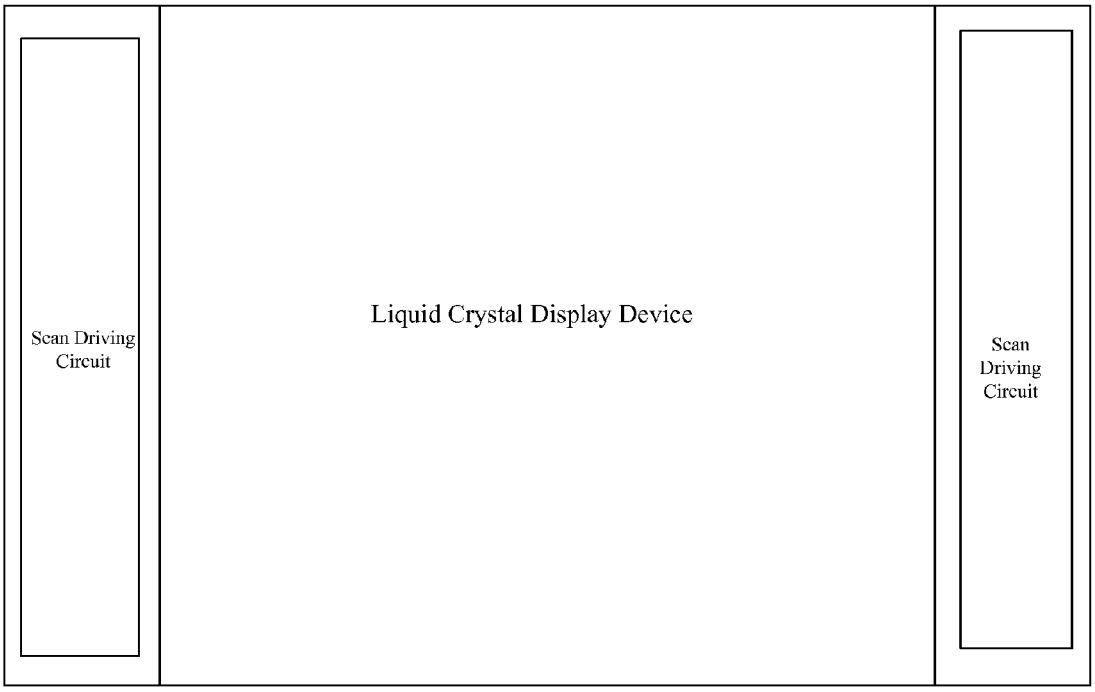
FIG. 6 is a schematic view of a liquid crystal display device of the invention.

Referring to FIG. 6, which is a schematic view of a liquid crystal display device of the invention. The liquid crystal display device includes the above-mentioned scan driving circuit 1, and two sides of the liquid crystal display device each are disposed with the scan driving circuit 1.

For the scan driving circuit of the invention, when the resetting module is in operation, the reset signal is at a low voltage level, the fifth controllable switch is controlled to be turned on, at this time, whatever the voltage levels at the control signal node and of the scan driving signal are, the turn-off voltage does not be provided to the control signal node, so that the normal resets of the control signal node and the scan driving signal can be achieved and the failure of the scan driving circuit can be avoided.

The foregoing discussion only is some embodiments of the invention, but it is not therefore limited to the patent scope of the invention, any equivalent structure or equivalent process transformations made according to the specification and the accompanying drawings of the invention, or directly or indirectly used in other related technical field, are similarly included within the scope of patent protection of the invention.

What is claimed is:

1. A scan driving circuit comprising:

an input module configured for receiving a preceding-stage control signal, a first clock signal and a second clock signal, performing a calculation on the preceding-stage control signal, the first clock signal and the second clock signal to obtain a first control signal and outputting the first control signal;

a resetting module, connected to the input module and configured for receiving a reset signal and resetting a control signal node of the scan driving circuit according to the reset signal;

a latching module, configured for receiving the first control signal outputted by the input module, receiving the first clock signal and the second clock signal, performing a calculation on the first control signal, the first clock signal and the second clock signal to obtain a second control signal, and latching and outputting the second control signal at the control signal node;

a logic processing module, connected to the latching module and configured for receiving the second control signal at the control signal node outputted by the latching module, receiving a third clock signal, performing a logical calculation on the second control signal and the third clock signal to obtain a logic control signal and outputting the logic control signal;

an output module, connected to the logic processing module and configured for receiving the logic control signal outputted by the logic processing module, performing a calculation on the logic control signal to obtain a scan driving signal and outputting the scan driving signal; and a scan line, connected to the output module and configured for transmitting the scan driving signal outputted by the output module to a pixel unit;

wherein the input module has a first output terminal for outputting the first control signal, the resetting module has a second output terminal, the latching module has a first input terminal for receiving the first control signal, the first output terminal, the second output terminal and the first input terminal are connected to a first common connection node among the input module, the resetting module and the latching module;

wherein the control signal node is a second common connection node between the latching module and the logic processing module;

wherein latching module comprises a first inverter connected between the first common connection node and the second common connection node and for inverting a signal at the second output terminal of the resetting module.

2. The scan driving circuit as claimed in claim 1, wherein the input module comprises first through fourth controllable switches and a second inverter; a control terminal of the first controllable switch is connected to receive the first clock signal, an input terminal of the first controllable switch is connected to a turn-on voltage terminal, an output terminal of the first controllable switch is connected to an input terminal of the second controllable switch, a control terminal of the second controllable switch is connected to receive the preceding-stage control signal and connected to a control terminal of the third controllable switch, an output terminal of the second controllable switch is connected to the first common connection node and an output terminal of the third controllable switch, an input terminal of the third controllable switch is connected to an output terminal of the fourth controllable switch, an input terminal of the fourth controllable switch is connected to a turn-off voltage terminal, a control terminal of the fourth controllable switch is connected to receive the second clock signal, an input terminal of the second inverter is connected to receive the second clock signal, and an output terminal of the second inverter is connected to output the first clock signal.

3. The scan driving circuit as claimed in claim 2, wherein the resetting module comprises a fifth controllable switch; a control terminal of the fifth controllable switch is connected to receive the reset signal, an input terminal of the fifth controllable switch is connected to the turn-on voltage terminal, an output terminal of the fifth controllable switch is as the second output terminal connected to the first common connection node.

4. The scan driving circuit as claimed in claim 3, wherein the latching module comprises sixth through tenth controllable switches and the first inverter; a control terminal of the sixth controllable switch is connected to receive the second clock signal, an input terminal of the sixth controllable switch is connected to the turn-on voltage terminal, an output terminal of the sixth controllable switch is connected to an input terminal of the seventh controllable switch, a control terminal of the seventh controllable switch is connected to a control terminal of the eighth controllable switch, the control signal node and the logic processing module, an output terminal of the seventh controllable switch is connected to an output terminal of the eighth controllable switch and the first common connection node, an input terminal of the eighth controllable switch is connected to an output terminal of the ninth controllable switch, an input terminal of the ninth controllable switch is connected to the turn-off voltage terminal, a control terminal of the ninth controllable switch is connected to an output terminal of the tenth controllable switch, a control terminal of the tenth controllable switch is connected to receive the reset signal, an input terminal of the tenth controllable switch is connected to the first controllable switch to receive the first clock signal, an input terminal of the first inverter is connected to the output terminal of the fifth controllable switch, an output terminal of the first inverter is connected to the control signal node, the control terminals of the seventh and eighth controllable switches and the logic processing module.

5. The scan driving module as claimed in claim 4, wherein the logic processing module comprises eleventh through fourteenth controllable switches; an input terminal of the eleventh controllable switch is connected to an input terminal of the twelfth controllable switch, a control terminal of the eleventh controllable switch is connected to the control signal node and a control terminal of the thirteenth controllable switch, an output terminal of the eleventh controllable switch is connected to an output terminal of the twelfth controllable switch, the output module and an output terminal of the thirteenth controllable switch, a control terminal of the twelfth controllable switch is connected to receive the third clock signal and connected to a control terminal of the fourteenth controllable switch, an input terminal of the thirteenth controllable switch is connected to an output terminal of the fourteenth controllable switch, and an input terminal of the fourteenth controllable switch is connected to the turn-off voltage terminal.

6. The scan driving circuit as claimed in claim 3, wherein the latching module comprises sixth through tenth controllable switches and the first inverter; a control terminal of the sixth controllable switch is connected to receive the second clock signal, an input terminal of the sixth controllable switch is connected to the turn-on voltage terminal, an output terminal of the sixth controllable switch is connected to an input terminal of the seventh controllable switch, a control terminal of the seventh controllable switch is connected to a control terminal of the eighth controllable switch, the control signal node and the logic processing module, an output terminal of the seventh controllable switch is connected to an output terminal of the eighth controllable switch and the first common connection node, an input terminal of the eighth controllable switch is connected to an output terminal of the ninth controllable switch, an input terminal of the ninth controllable switch is connected to an output terminal of the tenth controllable switch, a control terminal of the ninth controllable switch is connected to receive the first clock signal, a control terminal of the tenth controllable switch is connected to receive the reset signal, an input terminal of the tenth controllable switch is connected to the turn-off voltage terminal, an input terminal of the first inverter is connected to the output terminal of the fifth controllable switch, an output terminal of the first inverter is connected to the control signal node, the control terminals of the seventh and eighth controllable switches and the logic processing module.

7. The scan driving circuit as claimed in claim 6, wherein the logic processing module comprises eleventh through fourteenth controllable switches; an input terminal of the eleventh controllable switch is connected to an input terminal of the twelfth controllable switch, a control terminal of the eleventh controllable switch is connected to the control signal node and a control terminal of the thirteenth controllable switch, an output terminal of the eleventh controllable switch is connected to an output terminal of the twelfth controllable switch, the output module and an output terminal of the thirteenth controllable switch, a control terminal of the twelfth controllable switch is connected to receive the third clock signal and connected to a control terminal of the fourteenth controllable switch, an input terminal of the thirteenth controllable switch is connected to an output terminal of the fourteenth controllable switch, and an input terminal of the fourteenth controllable switch is connected to the turn-off voltage terminal.

8. The scan driving circuit as claimed in claim 3, wherein the latching module comprises sixth through ninth controllable switches and an AND gate; a control terminal of the sixth controllable switch is connected to receive the second clock signal, an input terminal of the sixth controllable switch is connected to the turn-on voltage terminal, an output terminal of the sixth controllable switch is connected to an input terminal of the seventh controllable switch, a control terminal of the seventh controllable switch is connected to a control terminal of the eighth controllable switch, the control signal node and the logic processing module, an output terminal of the seventh controllable switch is connected to an output terminal of the eighth controllable switch and the first common connection node, an input terminal of the eighth controllable switch is connected to an output terminal of the ninth controllable switch, an input terminal of the ninth controllable switch is connected to the turn-off voltage terminal, a control terminal of the ninth controllable switch is connected to an output terminal of the AND gate, a first input terminal of the AND gate is connected to receive the reset signal, a second input terminal of the AND gate is connected to receive the first clock signal, an input terminal of a first inverter is connected to the output terminal of the fifth controllable switch, an output terminal of the first inverter is connected to the control signal node, the control terminals of the seventh and eighth controllable switches and the logic processing module.

9. The scan driving circuit as claimed in claim 8, wherein the logic processing module comprises eleventh through fourteenth controllable switches; an input terminal of the eleventh controllable switch is connected to an input terminal of the twelfth controllable switch, a control terminal of the eleventh controllable switch is connected to the control signal node and a control terminal of the thirteenth controllable switch, an output terminal of the eleventh controllable switch is connected to an output terminal of the twelfth controllable switch, the output module and an output terminal of the thirteenth controllable switch, a control terminal of the twelfth controllable switch is connected to receive the third clock signal and connected to a control terminal of the fourteenth controllable switch, an input terminal of the thirteenth controllable switch is connected to an output terminal of the fourteenth controllable switch, and an input terminal of the fourteenth controllable switch is connected to the turn-off voltage terminal.

10. The scan driving circuit as claimed in claim 9, wherein the output module comprises third through fifth inverters connected in series; an input terminal of the third inverter is connected to the output terminals of the eleventh and thirteenth controllable switches, an output terminal of the third inverter is connected to an input terminal of the fourth inverter, an output terminal of the fourth inverter is connected to an input terminal of the fifth inverter, and an output terminal of the fifth inverter is connected to the scan line.

11. The scan driving circuit as claimed in claim 9, wherein the first controllable switch, the second controllable switch, the fifth through seventh controllable switches, the eleventh controllable switch and the twelfth controllable switch are PMOS-type thin film transistors; the third controllable switch, the fourth controllable switch, the eighth through tenth controllable switches, the thirteenth controllable switch and the fourteenth controllable switch are NMOS-type thin film transistors.

12. A liquid crystal display device comprising a scan driving circuit, wherein the scan driving circuit comprises:

an input module, configured for receiving a preceding-stage control signal, a first clock signal and a second clock signal, performing a calculation on the preceding-stage control signal, the first clock signal and the second clock signal to obtain a first control signal and outputting the first control signal;

a resetting module, connected to the input terminal and configured for receiving a reset signal and resetting a control signal node of the scan driving circuit according to the reset signal;

a latching module, configured for receiving the first control signal outputted by the input module, receiving the first and second clock signals, performing a calculation on the first control signal, the first and second clock signals to obtain a second control signal, and latching and outputting the second control signal at the control signal node;

a logic processing module, connected to the latching module and configured for receiving the second control signal at the control signal node outputted by the latching module, receiving a third clock signal, performing a logic calculation on the second control signal and the third clock signal to obtain a logic control signal, and outputting the logic control signal;

an output module, connected to the logic processing module and configured for receiving the logic control signal outputted by the logic processing module, performing a calculation on the logic control signal to obtain a scan driving signal, and outputting the scan driving signal; and a scan line, connected to the output module and configured for transmitting the scan driving signal outputted by the output module to a pixel unit;

wherein the input module has a first output terminal for outputting the first control signal, the resetting module has a second output terminal, the latching module has a first input terminal for receiving the first control signal, the first output terminal, the second output terminal and the first input terminal are connected to a first common connection node among the input module, the resetting module and the latching module;

wherein the control signal node is a second common connection node between the latching module and the logic processing module;

wherein latching module comprises a first inverter connected between the first common connection node and the second common connection node and for inverting a signal at the second output terminal of the resetting module.

13. The liquid crystal display device as claimed in claim 12, wherein the input module comprises first through fourth controllable switches and a second inverter; a control terminal of the first controllable switch is connected to receive the first clock signal, an input terminal of the first controllable switch is connected to a turn-on voltage terminal, an output terminal of the first controllable switch is connected to an input terminal of the second controllable switch, a control terminal of the second controllable switch is connected to receive the preceding-stage control signal and connected to a control terminal of the third controllable switch, an output terminal of the second controllable switch is connected to the first common connection node and an output terminal of the third controllable switch, an input terminal of the third controllable switch is connected to an output terminal of the fourth controllable switch, an input terminal of the fourth controllable switch is connected to a turn-off voltage terminal, a control terminal of the fourth controllable switch is connected to receive the second clock signal, an input terminal of the first second inverter is connected to receive the second clock signal, and an output terminal of the first second inverter is connected to output the first clock signal.

14. The liquid crystal display device as claimed in claim 13, wherein the resetting module comprises a fifth controllable switch; a control terminal of the fifth controllable switch is connected to receive the reset signal, an input terminal of the fifth controllable switch is connected to the turn-on voltage terminal, an output terminal of the fifth controllable switch is as the second output terminal connected to the first common connection node.

15. The liquid crystal display device as claimed in claim 14, wherein the latching module comprises sixth through tenth controllable switches and the first inverter; a control terminal of the sixth controllable switch is connected to receive the second clock signal, an input terminal of the sixth controllable switch is connected to the turn-on voltage terminal, an output terminal of the sixth controllable switch is connected to an input terminal of the seventh controllable switch, a control terminal of the seventh controllable switch is connected to a control terminal of the eighth controllable switch, the control signal node and the logic processing module, an output terminal of the seventh controllable switch is connected to an output terminal of the eighth controllable switch and the first common connection node, an input terminal of the eighth controllable switch is connected to an output terminal of the ninth controllable switch, an input terminal of the ninth controllable switch is connected to the turn-off voltage terminal, a control terminal of the ninth controllable switch is connected to an output terminal of the tenth controllable switch, a control terminal of the tenth controllable switch is connected to receive the reset signal, an input terminal of the tenth controllable switch is connected to the first controllable switch to receive the first clock signal, an input terminal of the first inverter is connected to the output terminal of the fifth controllable switch, an output terminal of the first inverter is connected to the control signal node, the control terminals of the seventh and eighth controllable switches and the logic processing module.

16. The liquid crystal display device as claimed in claim 14, wherein the latching module comprises sixth through tenth controllable switches and the first inverter; a control terminal of the sixth controllable switch is connected to receive the second clock signal, an input terminal of the sixth controllable switch is connected to the turn-on voltage terminal, an output terminal of the sixth controllable switch is connected to an input terminal of the seventh controllable switch, a control terminal of the seventh controllable switch is connected to a control terminal of the eighth controllable switch, the control signal node and the logic processing module, an output terminal of the seventh controllable switch is connected to an output terminal of the eighth controllable switch and the first common connection node, an input terminal of the eighth controllable switch is connected to an output terminal of the ninth controllable switch, an input terminal of the ninth controllable switch is connected to an output terminal of the tenth controllable switch, a control terminal of the ninth controllable switch is connected to receive the first clock signal, a control terminal of the tenth controllable switch is connected to receive the reset signal, an input terminal of the tenth controllable switch is connected to the turn-off voltage terminal, an input terminal of the first inverter is connected to the output terminal of the fifth controllable switch, an output terminal of the first inverter is connected to the control signal node, the control terminals of the seventh and eighth controllable switches and the logic processing module.

17. The liquid crystal display device as claimed in claim 14, wherein the latching module comprises sixth through ninth controllable switches and an AND gate; a control terminal of the sixth controllable switch is connected to receive the second clock signal, an input terminal of the sixth controllable switch is connected to the turn-on voltage terminal, an output terminal of the sixth controllable switch is connected to an input terminal of the seventh controllable switch, a control terminal of the seventh controllable switch is connected to a control terminal of the eighth controllable switch, the control signal node and the logic processing module, an output terminal of the seventh controllable switch is connected to an output terminal of the eighth controllable switch and the first common connection node, an input terminal of the eighth controllable switch is connected to an output terminal of the ninth controllable switch, an input terminal of the ninth controllable switch is connected to the turn-off voltage terminal, a control terminal of the ninth controllable switch is connected to an output terminal of the AND gate, a first input terminal of the AND gate is connected to receive the reset signal, a second input terminal of the AND gate is connected to receive the first clock signal, an input terminal of a first inverter is connected to the output terminal of the fifth controllable switch, an output terminal of the first inverter is connected to the control signal node, the control terminals of the seventh and eighth controllable switches and the logic processing module.

18. The liquid crystal display device as claimed in claim 17, wherein the logic processing module comprises eleventh through fourteenth controllable switches; an input terminal of the eleventh controllable switch is connected to an input terminal of the twelfth controllable switch, a control terminal of the eleventh controllable switch is connected to the control signal node and a control terminal of the thirteenth controllable switch, an output terminal of the eleventh controllable switch is connected to an output terminal of the twelfth controllable switch, the output module and an output terminal of the thirteenth controllable switch, a control terminal of the twelfth controllable switch is connected to receive the third clock signal and connected to a control terminal of the fourteenth controllable switch, an input terminal of the thirteenth controllable switch is connected to an output terminal of the fourteenth controllable switch, and an input terminal of the fourteenth controllable switch is connected to the turn-off voltage terminal.

19. The liquid crystal display device as claimed in claim 18, wherein the output module comprises third through fifth inverters connected in series; an input terminal of the third inverter is connected to the output terminals of the eleventh and thirteenth controllable switches, an output terminal of the third inverter is connected to an input terminal of the fourth inverter, an output terminal of the fourth inverter is connected to an input terminal of the fifth inverter, and an output terminal of the fifth inverter is connected to the scan line.

20. The liquid crystal display device as claimed in claim 18, wherein the first controllable switch, the second controllable switch, the fifth through seventh controllable switches, the eleventh controllable switch and the twelfth controllable switch are PMOS-type thin film transistors; the third controllable switch, the fourth controllable switch, the eighth through tenth controllable switches, the thirteenth controllable switch and the fourteenth controllable switch are NMOS-type thin film transistors.

* * * * *